US005711692A

United States Patent [19]

Pope

[11] Patent Number: 5,711,692

[45] Date of Patent: Jan. 27, 1998

[54] SECTIONALIZED SURFBOARD

[76] Inventor: Karl Dean Pope, 409 S. Fox St., Ojai, Calif. 93023

[21] Appl. No.: 812,086

[22] Filed: Mar. 4, 1997

Related U.S. Application Data

[63] Continuation-in-part of Ser. No. 620,130, Mar. 21, 1996, abandoned.

[51] Int. Cl.[6] ..... A63C 15/05

[52] U.S. Cl. ..... 441/74; 114/352

[58] Field of Search ..... 441/74, 79; 114/343, 114/352, 353, 354, 74 R, 74 T, 77 R, 77 A

[56] References Cited

U.S. PATENT DOCUMENTS

| | | | |
|---|---|---|---|
| 3,137,873 | 6/1964 | Garrolini . | |
| 3,287,754 | 11/1966 | Price et al. . | |
| 3,409,920 | 11/1968 | Brownley . | |
| 3,996,868 | 12/1976 | Schagen | 441/74 |
| 4,496,325 | 1/1985 | Tweg . | |
| 4,730,574 | 3/1988 | Diefendahl et al. . | |
| 4,807,549 | 2/1989 | Rhodes et al. . | |
| 4,829,926 | 5/1989 | Voelkel . | |
| 4,919,632 | 4/1990 | Smith et al. | 114/352 |

FOREIGN PATENT DOCUMENTS

| | | | |
|---|---|---|---|
| 52783 | 6/1982 | European Pat. Off. | 441/74 |

*Primary Examiner*—Stephen Avila
*Attorney, Agent, or Firm*—Michaelson & Wallace

[57] ABSTRACT

A sectionalized, disassemblable board-like hull which can be adapted for use as a surfboard, windsurfer, or the like. The hull preferably has two sections, i.e. front and rear. The hull sections are joined using a detachable securing device which includes a single loadbearing tube assembly extending into each section concentrically along a centrally located longitudinal axis of the hull. The securing device also includes a clamp assembly located in an upper surface of the hull and another clamp assembly located in a bottom surface of the hull. These clamp assemblies bridge the joint between the front section and the rear section, and when engaged, hold the front and rear sections together longitudinally. The clamp assemblies can each include a breakable link. This link has a tensile strength such that whenever the hull is subjected to a prescribed bending moment the link breaks and causes the corresponding clamp assembly to disengage. In addition, the tube assembly can be made to exhibit a bending strength such that whenever the hull is subjected to this prescribed bending moment the tube breaks or crimps. The prescribed bending moment is chosen to be less than a bending moment sufficient to fracture the hull sections during use. In this way, the relatively small, inexpensive, and easily replaced breakable link and tube assembly are sacrificed to save the hull sections should the hull be subjected to a bending moment which would otherwise be strong enough to cause a section to fracture and destroy the hull.

31 Claims, 5 Drawing Sheets

SECTIONALIZED SURFBOARD

This is a continuation-in-part of application Ser. No. 08/620,130, filed Mar. 21, 1996, now abandoned.

BACKGROUND

1. Technical Field

This invention relates to water sports equipment, and more particularly to a sectionalized board-like hull such as would be used with a surfboard and the like. The sectionalized hull can be disassembled and packaged for easy transportation and storage. In addition, the invention relates to a sectionalized hull which provides protection against catastrophic fracturing or its breaking apart during use, thereby rendering it unusable.

2. Background Art

The sport of surfing has become established throughout the world. Professional and amateur surfing competitions and clubs are common. Surfers of all ages bring their surfboards to the beach to participate in the sport. Some surfing enthusiasts will travel long distances with their boards to surf waters renowned for the best surfing conditions. As a consequence, surfboards are often strapped to the top of automobiles, carried on public transportation, and/or checked as baggage on commercial airline flights. These methods of transporting a surfboard, however, can present considerable inconvenience and difficulty as modern boards are seven to ten feet long. Surfboards strapped to the exterior of an automobile are susceptible to damage and theft, and a special roof-top carrier is often necessary to prevent damage to the automobile. In addition, transporting a surfboard can be expensive. For example, commercial airlines will typically charge an extra fee for transporting a surfboard due to special handling requirements and potential damage.

Attempts have been made in the past to provide a multi-section surfboard which can be disassembled into shorter component sections and packaged for transport (e.g. in a protective carrying case). A surfboard so packaged can be placed inside an automobile (e.g. the trunk) or checked as regular luggage on commercial airline flights, thereby alleviating many of the aforementioned problems associated with transporting a board. Although these previous sectionalized surfboards worked reasonably well, they typically employed complex multi-part devices for joining the sections of the board. Such joining devices were designed to hold the board sections together and in proper alignment in the face of the substantial loading forces associated with surfing. The goal was to provide a sectionalized surfboard which when assembled withstood the structural stresses and strains of surfing while duplicating the stiffness, strength, and performance of a surfboard having a conventional one-piece construction. This goal was obtained, however, the weight and complexity of these previously employed joining devices is problematic.

The foam core and fiberglass skin construction of modern surfboards provides a lightness of weight which is deemed essential to the board's performance. The added weight attributable to the aforementioned joining devices would be detrimental to the performance of the sectionalized surfboard. All current joining devices employed in sectionalized surfboards are known to add a substantial amount of weight to a the board. Thus, there is a need to reduce the weight added to a sectionalized surfboard by the devices used to join its sections together. In addition, it is desirable to simplify the current joining devices and reduce the number of parts thereof so as to make assembly and disassembly of the surfboard sections more convenient, as well as to subtract any added weight attributable to the eliminated pads.

Accordingly, one object of the present invention is to provide a sectionalized surfboard employing a system for joining the sections together in such a manner as to withstand the stresses and strains to which the board is subjected during surfing, while at the same time minimizing the weight added to the board by the joining system. In addition, it is also an object of the present invention to provide such a sectionalized board which is readily and conveniently assembled and disassembled by hand without special tools, and which has a joining system with a minimum number of pads.

Another issue confronting suffers is the durability of the modern foam and fiberglass surfboard constructions. Essentially, these modern surfboards have a shaped plastic foam core, usually made of a polyurethane foam, and a hard outer shell made of resin impregnated fiber glass cloth. Typically, a light-weight wooden slat called a stringer runs edgewise down the center of the board. The stringer is used to provide support to the core and retain its shape prior to the application of the fiberglass shell. The stringer also becomes an integral pad of the surfboard when construction is complete and adds to the rigidity of the board due to its on edge orientation.

While being light-weight, these modern surfboards are very susceptible to being fractured or broken into pieces by the action of the waves, or by striking solid objects in the water (e.g. rocks, pilings, etc.). A suffer who suds regularly can expect a surfboard to last on average only about six months before it is broken, generally in half as the stresses are greatest in the center of the board. In addition, it is common for a competitive suffer to go through several boards at a single surfing contest. This fragility is not only costly in that replacement boards have to be procured, but can be quite a disappointment for a surfer should the broken board have been a favorite. In addition, many of the best surfing spots can be at remote locations. Should a board break in one of these locations, a replacement may not be readily available. Thus, a broken board can mean the end of the fun, and perhaps a wasted trip.

Current sectionalized surfboards provide no relief for the fragility problems associated with the modern foam and fiberglass constructions. Granted, the joints between board sections may actually be stronger than the rest of the surfboard due to the aforementioned joining devices. However, this only means that the board will sustain a catastrophic fracture or break apart at a weaker location away from the joint. Consequently, there is a need for a surfboard which retains the lightness of weight afforded by the foam and fiberglass constructions, but which overcomes the problems associated with the fragility of such designs.

Thus, it is another object of the present invention to provide a sectionalized surfboard wherein the system for joining the sections together includes a breakaway system for protecting the foam and fiberglass portions of the board from being catastrophically fractured or broken apart during use.

Many surfboards are custom made, often to a surfer's specifications. Essentially, the customizing entails shaping the foam core by hand to the desired specifications and then applying the fiberglass skin. Because the shaping is done by hand, each board will be somewhat different even though the same specifications were employed. Thus, a particular board may provide just the performance characteristics the surfer desires, whereas a replacement may not. The same concept can apply to non-custom surfboards. A surfer may purchase a particular model surfboard that is to his or her liking, only to find the model unavailable or discontinued when a replacement is needed. Therefore, the loss of a surfboard due to its being fractured or broken apart can not only be expensive, but a frustrating experience as well since a favorite board may not be able to be adequately replaced. In view of this, there is a need to incorporate a protective system in existing one-piece surfboards, as well.

In addition to the desire to protect existing one-piece surfboards from the above-described damage during use, it is also advantageous to convert an existing one-piece board into sectionalized board. In this way, a favorite board can be disassembled to facilitate its handling and transportation.

Consequently, it is a further object of the present invention that the aforementioned system for joining the sections together, and/or system for protecting the foam and fiberglass portions of the board from being fractured or broken apart during use, be incorporatable into an existing one-piece surfboard. In this way a favorite board can be modified to enjoy the benefits of the present invention.

Finally, it is noted that the above-described problems also face users of related equipment which employ board-like hulls similar to a surfboard, such as windsurfing boards, life guard paddle boards, kayaks, surf skis, and the like. Thus, the objectives of the present invention apply equally to these other types of equipment.

SUMMARY

The foregoing objectives are realized by a sectionalized, disassemblable board-like hull which can be adapted for use as a surfboard, windsurfer, or the like. The hull preferably has two sections, i.e. front and rear. Hulls having more than two section are also possible, but would increase the weight and number of parts. To assemble the hull for use, the front and rear section are placed in longitudinal alignment so that a respective interfacing surface of each abuts and forms a joint between the sections. A device for detachably securing the sections is also incorporated. This securing device includes a single loadbearing tube assembly extending concentrically along a centrally located longitudinal axis of the hull at the joint. A potion of the tube assembly extends into a hole formed in the front section through its interfacing surface and the remaining length of the assembly extends into a hole in the rear section through its interfacing surface. The securing device also can include a clamp assembly located in an upper surface of the hull and another clamp assembly located in a bottom surface of the hull. These clamp assemblies bridge the joint between the front section and the rear section, and when engaged, hold the front and rear sections together longitudinally. One clamp assembly per side of the hull is preferred so as to keep the weight of the securing device low. However, multiple, laterally spaced clamps assemblies can be used on either or both sides of the board, if desired. Where only one clamp assembly is employed per side, each is disposed as close to a longitudinal midline of the hull as possible, without interfering with the tube assembly. In a case where the clamps must be offset laterally to accommodate the tube assembly, it is preferred that they be disposed on opposite sides of the midline. The hull is disassembled by releasing the clamps and separating the sections. The disassembled hull can then be packaged, such as in a carrying case, for easy transport and storage.

In addition to preferably employing just two sections and one clamp assembly per side to keep the weight and number of pads added to the hull by the securing device at a minimum, the securing device is also advantageously made from light-weight materials. For example, the various pads of the device could be made from aluminum, plastic, resin-fiber composite material, or any combination thereof.

In one embodiment of the invention it is preferred that the tube assembly exhibit a bending and shear strength which approximately equals or exceeds the bending and shear strength associated with hull sections. In this way, the sectionalized hull is at least as strong as a conventional one-piece hull.

However, in an alternate embodiment the clamp assemblies each include a breakable link. This link has a tensile strength such that whenever the hull is subjected to a prescribed bending moment the link breaks first and causes the corresponding clamp assembly to disengage. In addition, the tube assembly exhibits a bending strength such that whenever the hull is subjected to this prescribed bending moment the tube breaks or crimps. The prescribed bending moment is chosen to be less than a bending moment sufficient to fracture the hull sections during use (such as during surfing if the sectionalized hull is used as a surfboard). In this way, should the hull be subjected to a bending moment which would be strong enough to cause a section to fracture, the relatively small, inexpensive, and easily replaced breakable link and tube assembly fail instead and the hull is saved from catastrophic failure.

The sectionalized hull also has a device for maintaining the front section in rotational alignment with the rear section about the longitudinal axis. This device may take the form of one or more interfacing pin and socket assemblies, or alternately may employ a meshable interlocking pattern formed on the interfacing surfaces. In the latter case, a raised pattern on one interfacing surface meshes with a reversed matching pattern on the abutting interfacing surface to prevent the aforementioned rotation.

The interfacing surfaces preferably have a flexible face plate made of an elastically compressible material, such as rubber or plastic, which is attached to a rigid backing plate. The clamp assemblies are also preferably capable of being adjusted so as to vary the compressive force placed on each face plate. Accordingly, a compressive preload can be placed on the flexible face plates using the clamps. This has a significant advantage. For example, the surface of the hull tends to pull apart at the surface of the joint on one side, while compressing on the other side when the hull is subjected to forces causing a bending moment therein. On the side being pulled apart, a gap could form. This gap may pinch a user's skin or clothes when it closes. However, a compressive preload on the flexible face plates counters the force associated with this bending moment. Thus, the plates merely decompress somewhat without actually separating and creating a gap. In addition, the compression caused by the bending moment on the other side of the hull could damage the compressed area. The use of flexible face plates prevents this damage because they will compress further to absorb the forces associated with the bending moment. And finally, the compressive preload acts to take up small irregularities in the interfacing surfaces.

A new sectionalized hull is either formed in sections with the securing device added afterwards, or it is formed in one-piece, cut into two or more sections and then fitted with the securing device(s). This latter method has the added advantage that it can be used to modify existing one-piece hulls (e.g. a surfboard) to produce a sectionalized hull in accordance with the present invention. In this way, a existing structure can be retrofitted to make its transport and storage easier, and also to protect it from being fracture or broken apart during use.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

Preferred embodiments of the present invention will now be described with reference to the drawings. The example of a surfboard will be used to illustrate these embodiments. However, it is not intended that the invention be limited to just surfboards. Rather, other similar board-like hulls, such as those employed in windsurfers, life guard paddle boards, kayaks, surf skis, and the like, could also be adapted to incorporate the following preferred embodiments.

Figure 1A:
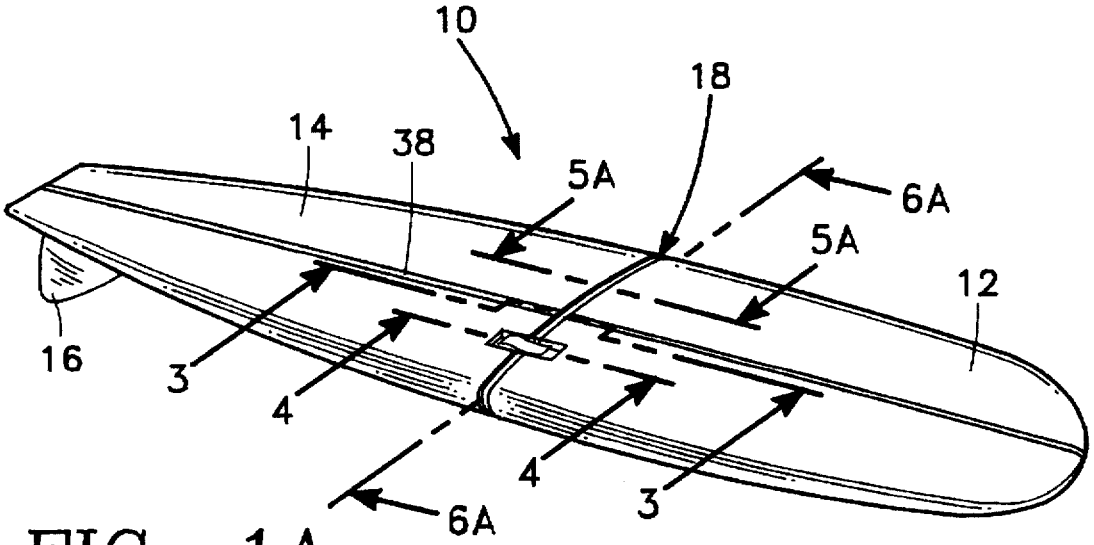
FIG. 1A is a perspective view of a preferred embodiment of the sectionalized surfboard according to the present invention shown in its assembled condition.
Figure 2:
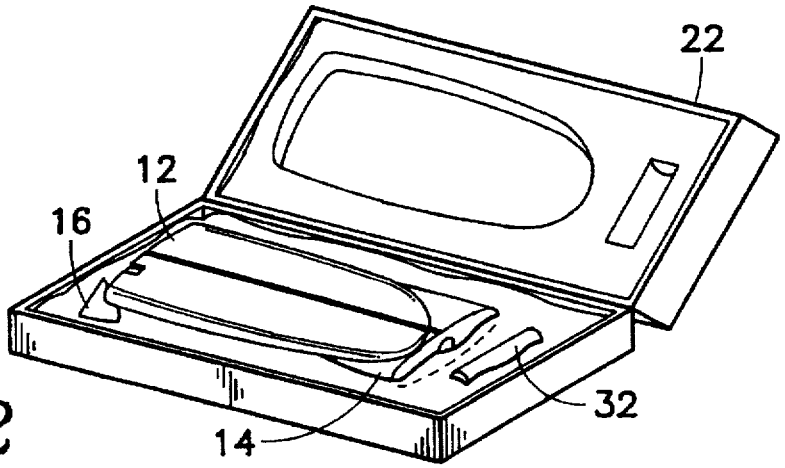
FIG. 2 is a perspective view of the surfboard of FIG. 1 shown completely disassemble and installed in a carry case.

FIG. 1A depicts an assembled sectionalized surfboard 10 in accordance with the present invention which generally comprises two sections, i.e. a front section 12, and a rear section 14. The rear section 14 also includes a skeg 16. This skeg 16 can be fixed, although it is preferred that it be a removable type as is well known in the surfboard art. A removable skeg facilitates the packaging of the disassembled surfboard 10 as it can be detached from the rear section 14 and placed along side the board sections 12, 14 in a protective carrying container 22 for transport or storage (as shown in FIG. 2). Thus, the protective case 22 can be made smaller for easier handling.

Figure 1B:
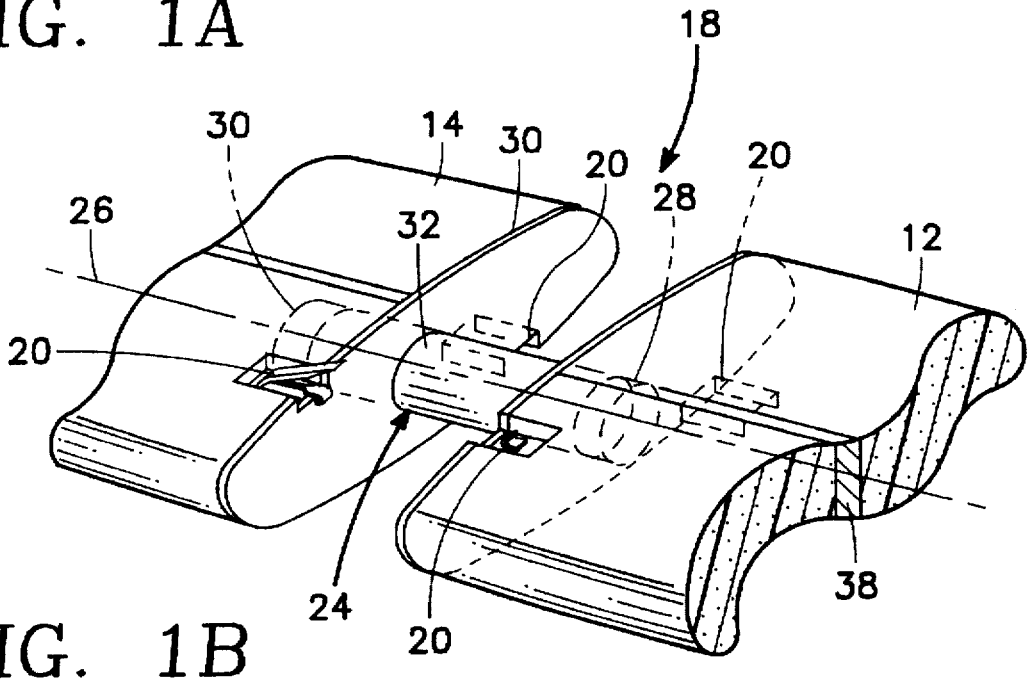
FIG. 1B is a perspective view of the surfboard of FIG. 1 shown partially disassembled.

The front and rear sections 12, 14 are preferably about the same length, thereby each representing approximately one-half of the surfboard 10. Each section 12, 14 is adapted to be rigidly connected in longitudinal alignment with the other by a joining system 18. This joining system 18, shown in detail in the semi-exploded view of FIG. 1 B, includes a pair of clamp assemblies 20 and a single loadbearing tube assembly 24. It is preferred that the clamp assemblies 20 be as close to the longitudinal midline of the surfboard 10, as possible because the forces which act to pull the sections 12, 14 apart at the upper and lower surfaces will be maximum at the midline of the board. Ideally, the clamp assemblies 20 would be disposed at the midline of the board 10. However, as will be explained in more detail later, ensuring that the tube assembly 24 exhibits a desired stiffness may require that its cross-sectional dimensions (in comparison to the thickness of the board 10) be so large that there would not be enough room to place the clamp assemblies 20 at the midline of the board 10 without interfering with the tube assembly 24. It is believed this would be the typical case, except with very thick surfboards. Accordingly, offsetting the clamp assemblies 20 from the midline of the board 10 will often be required. FIGS. 1A–B depict an embodiment with offset clamp assemblies 20. In this offset embodiment the distance separating each clamp assembly 20 from the axis 26 is preferably only large enough so that the clamp assemblies clear the tube assembly 24. In this way the clamps assemblies 20 are as close to the longitudinal axis 26 of the board 10 as possible without interfering with the tube assembly 24. One clamp assembly 20 is disposed in the top side of the board 10 just off to one side of the surfboard's longitudinal central axis 26 at the joint between the two sections 12, 14. The other clamp assembly 20 is disposed in the bottom side of the board 10 just off to the side of the longitudinal axis 26 opposite that of the clamp assembly 20 disposed in the top side of the board 10. It is irrelevant which side of axis 26 a particular clamp assembly 20 is disposed, as long as it is on the side opposite to the other assembly. In addition, it is preferable that each clamp assembly 20 is spaced laterally from the longitudinal axis 26 by the same distance. This ensures symmetric preloading forces on the two board sections 12, 14, as will be discussed in more detail later in this description.

Figure 3:
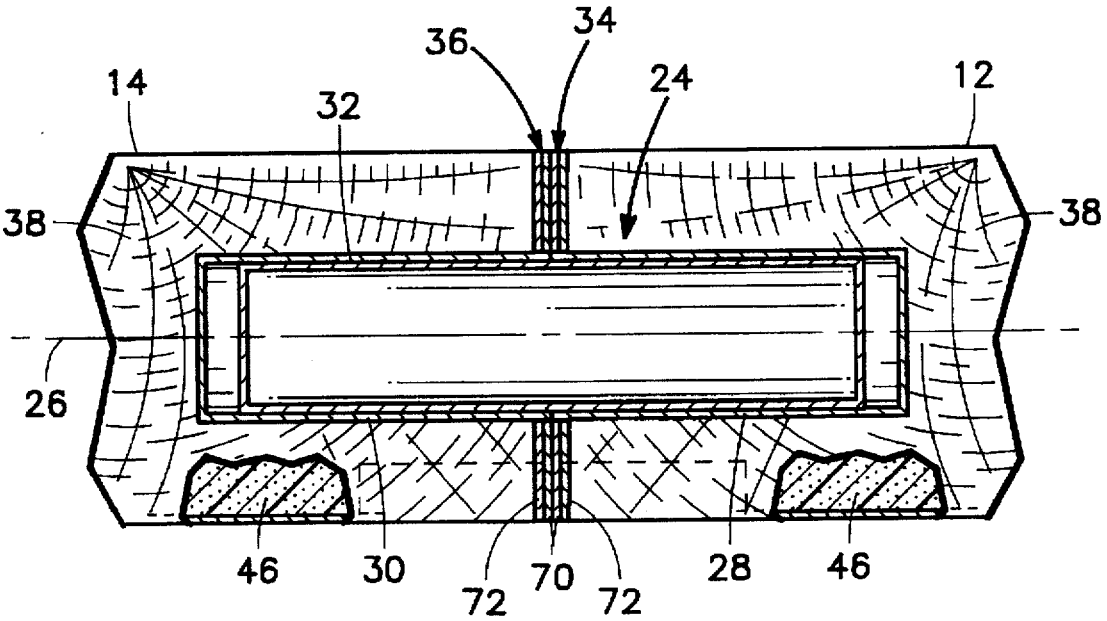
FIG. 3 is a cross-sectional view taken along line 3—3 of FIG. 1.

The tube assembly 24 is disposed longitudinally in the center of the surfboard across the joint between the front and rear sections 12,14, as shown in FIG. 3. The tube assembly 24 includes a pair of sleeves 28, 30 and a loadbearing tube 32. One sleeve 28 is disposed within the front section 12 of the board so as to be concentric with the longitudinal axis 26. The other sleeve 30 is similarly disposed in the rear section 14. Each sleeve 28, 30 has an open end opening out from the interfacing surface 34, 36 of the respective sections 12, 14. The other end of each sleeve 28, 30 which faces the interior of its associated board section 12, 14 is closed. This prevents sand and water from infiltrating into the interior of the sections 12, 14, as any such infiltration could damage the core and eventually ruin the surfboard 10. The sleeves 28, 30 have a wall thickness and composition sufficient to make them stiff, preferably having a stiffness approximately the same or greater than that of the surfboard 10 itself in the longitudinal direction. At the same time it is desired that the sleeves 28, 30 be as light weight as possible. It is believed a sleeve made of aluminum, plastic, or a resin-fiber composite material with the appropriate wall thickness could provide the desired lightness of weight and stiffness. In a tested embodiment of the present invention, an aluminum sleeve with a wall thickness of 0.049 inch was employed with satisfactory results.

The loadbearing tube 32 is designed to slide into the sleeves 28, 30. When the sectionalized surfboard 10 is assembled, approximately one-half of the tube 32 is disposed in the sleeve 28 associated with the front section 12 of the board and the remaining length of the tube 32 is disposed in the sleeve 30 associated with the rear section 14 of the board (as shown in FIG. 3). The tube 32 is closed at both ends to prevent water from entering it when the board 10 is being used, and thereby increasing the weight of the board.

To facilitate assembly and disassembly of the sections 12, 14, it is preferred that the outside diameter of the tube 32 be slightly less than the inner diameter of the sleeves 28, 30. Specifically, it is preferred that the aforementioned diameters be such that a close sliding fit is established between the tube 32 and the sleeves 28, 30. The tube 32 is also shorter than the combined length of the sleeves 28, 30, thereby creating clearance space between one or both of the inner ends of the sleeves 28, 30 and the tube 32 when the board sections 12, 14 are assembled. This clearance space allows the front and rear sections 12, 14 to be tightly joined together by the clamp assemblies 20, 22 without interference from the tube assembly 24. In addition, should any debris (e.g. sand) find its way into the sleeves 28, 30 prior to the board's assembly, it is pushed to the clearance space at the inner end the sleeves by the tube 32. Assuming the amount of debris is small (as it typically would be) the clearance space will be adequate to contain it without effecting the ability to tightly join the section 12, 14 together. In a tested embodiment of the surfboard, the combined length of the sleeves 28, 30 was 24.0 inches (i.e. 12.0 inches each) and the length of the tube 32 was 23.5, inches. It was found that the resulting clearance space of 0.5 inch was more than adequate to ensure the surfboard sections 12, 14 could be tightly joined without any gap therebetween.

The outer diameter and wall thickness of the tube 32 are critical dimensions of the tube assembly 24, as they will determine the loadbearing capacity of the assembly 24. The clamp assemblies 20 for the most part, simply hold the two sections 12, 14 of the board together in the longitudinal direction. Almost all of the bending and shear forces exerted on the board are borne by the tube 32. In one preferred embodiment, the tube 32 exhibits approximately the same or greater bending and shear strength as the foam and fiberglass sections 12, 14. In this way the sectionalized surfboard 10 of the present invention is at least as strong as a conventional board. Like the sleeves 28, 30, it is believed a tube made of aluminum, plastic, or a resin-fiber composite material with the appropriate wall thickness could provide a desired lightness of weight and the necessary bending and shear strength. In the tested embodiment of the present invention, an aluminum tube with an outer diameter of 1.875 inches and a wall thickness of 0.49 inch provided the desired strength characteristics in a ten foot surfboard having a standard size and shape. The outer diameter of the tube 32, once selected, dictates what the inner diameter of the sleeves 28, 30 must be to provide the preferred sliding fit between these components. In the tested embodiment, sleeves 28, 30 having an inner diameter of 1.902 inches were employed to obtain the desired fit. It is noted that the outside diameter of the tube assembly 24 is limited by the thickness of the surfboard 10 at the location of the joint between the two sections 12, 14. Preferably, the tube's 32 diameter is no more than about 90 percent of the width of the board at the joint between the sections 12, 14. The typical thickness of a conventional foam and fiberglass board is approximately 2.5 inches in this area. The sleeves 28, 30 employed in the tested embodiment had a outside diameter of 2.0 inches, and so were within the preferred 80 percent limit.

One potential problem with the incorporation of the sleeves 28, 30 into the respective sections 12, 14 involves displacement of the foam material making up the core 46 of the surfboard by the sleeves during surfing. In use, a surfboard tends to flex slightly, typically bowing downward near the longitudinal midpoint under the weight of the suffer on top and the force of the water on the bottom of the board. As the tube assembly is relatively stiff, this flexing may create a compressive force on the foam material surrounding the sleeves 28, 30. The foam material typically used to form the core 46 of a modern surfboard (i.e. polyurethane foam) is susceptible to permanent deformation from these compressive forces. Thus, over time, the foam would tend to recede from the tube assembly 24, especially in the area above the sleeves 28, 30. This being the case, the foam core 46 may no longer provide adequate support for tube assembly 24. Fortunately, all conventional foam and fiberglass surfboards include a light-weight wooden stringer which runs edgewise along the midline of a surfboard (as described previously). This stringer 38 (as best seen in FIGS. 1A–B) can be advantageously used to provide added support to the tube assembly 24, particularly in the aforementioned vulnerable area above the sleeves 28, 30. The sleeves 28, 30 are embedded into the stringer 38. Although part of the wooden stringer 38 is replaced by the tube assembly 24, a portion of the stringer still exists above and below the sleeves 28, 30. It has been found that the additional support provided by the remaining portion of the stringer 38 above and below the sleeves 28, 30 is sufficient to prevent the degeneration of the foam core 46 in that area if the tube assembly diameter is about the preferred 80 percent or less of the overall thickness of the board 10 at the joint between the sections 12, 14. Thus, although the tube assembly diameter could be larger, it is preferred that it not exceed the aforementioned 80 percent limit.

It is noted that the diameter of the tube assembly 24 can be made relatively small in relation the thickness of the surfboard 10, as long as it still provides the desired stiffness. Making the tube assembly diameter relatively small has the advantage of allowing the clamp assemblies 20 to be placed at the midline of the board 10 without any interference. However, given the same wall thickness, the stiffness of the tube portion 32 of the tube assembly will decrease in proportion to the cube of its diameter. As such, even small changes in the diameter can have a significant impact on the stiffness of the tube 32. Thus, there is a practical limit to how small the tube assembly's diameter can be while still providing the necessary stiffness. In the tested embodiment using an aluminum tube with a 0.049 inch wall thickness, the overall diameter of the tube assembly 24 could not be reduced below 50 percent of the thickness of the board 10. On the other hand, it is believed that tubes made of stiffer materials and/or having thicker walls could employ even smaller diameters, perhaps 25 percent or less of the board's thickness.

Figure 4:
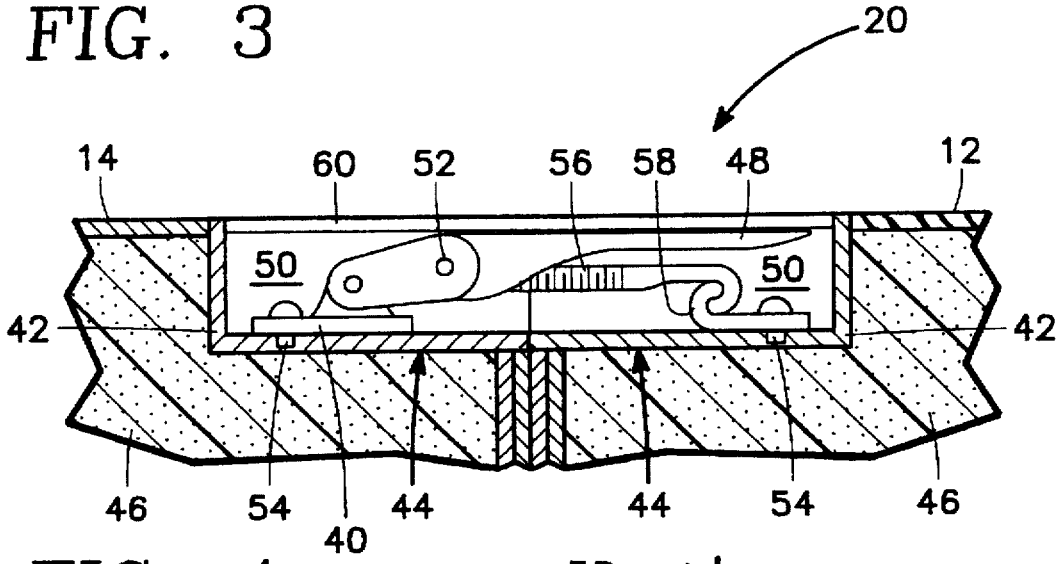
FIG. 4 is a cross-sectional view taken along line 4—4 of FIG. 1.

Referring now to FIG. 4, the preferred structure of the clamp assemblies 20 will be described. Each clamp assembly 20 has a cam action type clamp which allows for a quick engagement and release, thereby facilitating the assembly and disassembly of the board sections 12, 14. An example of suitable clamp is a Model No. 51L Tension Latch manufactured by the Camloc division of Fairchild Corporation. A clamp bracket 42 is disposed in each of mating recesses 44 formed in the core portions of the respective sections 12, 14. The brackets 42 are permanently affixed in their associated recesses 44 by any appropriate method, such as by the use of an adhesive. The brackets can be made of any lightweight, corrosion resistant material, such as aluminum, injection molded plastic or a resin-fiber composite material. The clamp fits in a rectangular pocket 50 formed in the top of each bracket 42. Preferably, the top of the clamp 42 is almost flush with the surface of the surfboard when installed in the brackets 42. The depth of each recess 44 is small compared to the thickness of the board at the joint between the sections 12, 14. By way of specific example, the recesses 44 advantageously have a depth of on the order of 1.0 inch for a board having a thickness of about 2.5 inches at the joint.

Each clamp includes a lever portion 48 pivoted at 52 in relation to a clamp base 40. The base 40 is affixed to one of the clamp brackets 42 by bolts 54. The lever portion 48 also has an adjustable lock piece 56 adapted to engage a fixed lock piece 58. The fixed lock piece 58 is affixed to the adjacent clamp bracket 42 by bolts 54. Each of these clamp parts are preferably made of stainless steel or like rust-resistant metal, although plastic or resin-fiber composite materials would be acceptable if of comparable strength. It is also preferred that the clamping assembly 20 include a smooth cover 60 to prevent a surfer's clothes or body from catching on the clamp. The cover 60 is attached to the lever portion 48 and covers the top of the clamp assembly 20. The top surface of the cover 60 is approximately flush with the surface of the board 10.

The operation of the clamp assembly 20 will be seen to be such that when the lever portion 48 is in a disengaged position the adjustable lock piece 56 is not hooked to the fixed lock piece 58. To engage the lever portion 48 it is rotated in a counterclockwise direction until the adjustable lock piece 56 can be hooked to the fixed lock piece 58. Once the lock pieces 56, 58 are hooked together, the lever portion 48 is rotated in a clockwise direction to a position approximately parallel with the surface of the surfboard. This causes the adjustable lock piece 56 to be translated away from the permanent lock piece 58, thereby exerting a substantial force which pulls the two sections 12, 14 of the board together. Preferably, each clamp assembly 20 is capable of exerting a compressive force on the board sections 12, 14 of up to about 200 pounds. Although, a compressive force of 100 pounds has been found to be completely satisfactory for rigidly securing together respective sections 12, 14 of the surfboard.

The compressive force supplied by the clamp assemblies 20 may be varied by adjusting the adjustable lock piece 56 when the lever portion 48 is disengaged. Specifically, the compressive force provided by the clamp assembly 20 may then be increased or decreased by rotating the adjustable lock piece 56 relative to the lever portion 48.

Referring once again to FIG. 3, the interfacing surfaces 4, 36 each include a face plate 70. These face plates 70 are preferably made of a flexible, elastically compressible material, such as rubber or plastic having a thickness between about ⅛ inch and ¼ inch. The clamping assemblies 20 are preferably configured so as to impart a preload compression on the order of 100 pounds, as discussed previously. This preload causes a compression of each the face plates 70 and has a distinct advantage as will now be explained. Although the tube assembly 24 will resist most of the bending moments to which the surfboard is subjected, the board is by nature somewhat flexible. In view of this, it is possible that a some residual forces might be imparted to the top and bottom surfaces of the board. Typically, this would entail a compressive force on the top surface of the board, and a tensile force on the bottom surface. The flexible face plates 70 help to dissipate these residual forces. Specifically, the preload at the joint on the bottom surface of the board is relaxed by the residual tensile force, thereby decompressing the face plates 70 in that area to some extent. However, assuming the preload chosen exceeds the residual tensile force (as typically it would), the decompression at the bottom surface of the board 10 will not be enough to cause a gap to form at the joint between the sections 12, 14. This precludes any possibility of a surfer getting his or her skin or clothing pinched between the abutting sections 12, 14. Additionally, the extra compressive force placed on the top of the board will be absorbed by further compression of the flexible face plates 70 in that area. Thus, the adjacent board structures are not subjected to potentially damaging forces.

Although, the face plates 70 could be attached directly to the foam core portion of each surfboard section, it is preferred that a more rigid backing plate 72 be interposed between the end of each section 12, 14 and its associated plate 70. The addition of a rigid backing plate 72 will prevent deformation of the core material should the flexible face plate 70 be impacted. It is preferred the backing plate 72 be constructed of a lightweight material such as a laminated fiber glass layer, or a thin, hard plastic sheet such as Formica.

The tube assembly provides most of the strength associated with the joint between the board sections to resist bending moments and shear forces exerted on the surfboard. The clamping assemblies for the most part provide resistance to forces tending to pull the two sections of the board apart in the longitudinal direction (although they do resist some small portion of the bending and shear). However, it is believed that neither of these structures will provide adequate resistance to a longitudinal torsion (i.e. twisting caused by forces which would tend to rotate the front section in relation to the rear section about the longitudinal axis). Without a provision to resist this torsion, the joint between the section could become misaligned, thereby effecting the performance and surfability of the board.

Figure 5A:
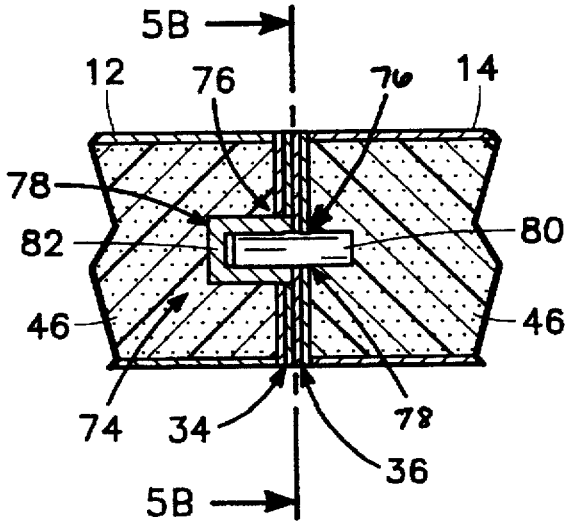
FIG. 5A is a cross-sectional view taken along line 5A—5A of an embodiment of FIG. 1 having a pin and socket assembly.
Figure 5B:
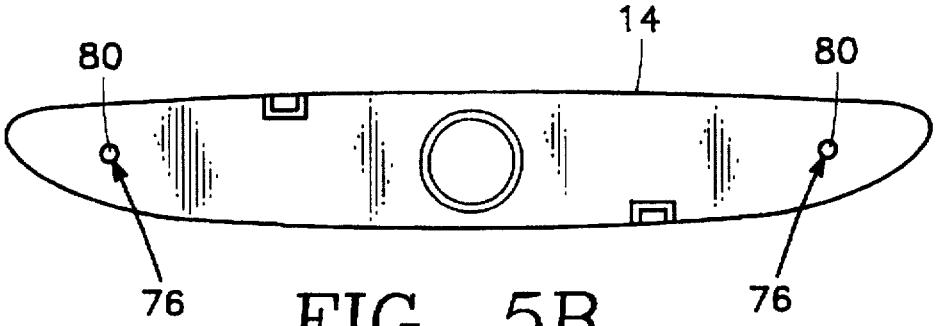
FIG. 5B is a cross-sectional view taken along line 5B—5B of FIG. 5A

One embodiment of the present invention, shown in FIGS. 5A–B, includes a pin and socket assembly 74 to provide the necessary resistance to the any torsion to which the surfboard is subjected. A pin and socket assembly 74 is incorporated into the interfacing surfaces 34, 36 at a location just inboard of the surfboard's side rail. Preferably, there are two pin and socket assemblies 74, one disposed on each side of the of the board, as best shown in FIG. 5B. To this end, each interfacing surface 34,36 is provided with a circular aperture 76 which when the board sections 12, 14 are joined together abut one another in a concentric fashion. A bore 78 is formed in the surfboard's core 46 behind each aperture 76. The pin and socket assembly 74 is installed in the abutting apertures 76 and bores 78 and secured in any appropriate manner, such as with an adhesive. Specifically, a pin 80 is mounted in one of the bores 78 and projects out from the associated aperture 76. The socket 82 is installed in the opposing aperture 76 and bore 78. It is also noted that the socket could be eliminated by using the opposing aperture 76 and bore 78 as a de facto socket. Although the pin and socket location depicted in FIG. 5B is preferred, it is not intended to limit the present invention to a specific pin and socket assembly location. Rather, one or more pin and socket assemblies could be located anywhere on the interfacing surfaces of the board sections, if desired. The type of pin 80 and socket 82 employed, and the methods used to install them, can be any appropriate for the application. As these elements and methods are well known in the art and do not form a novel part of the present invention, no further detail will be provided herein. It is, however, preferred that the pin and socket assembly 74 be made of materials which are light weight and that the pin 80 be of sufficient diameter to resist typical twisting forces encountered by the surfboard when in use. As an example, it is believed pin and socket assemblies 74 made of a polypropylene material and including a pin 80 with a 0.5 inch diameter will provide the necessary resistance to twisting forces while being very lightweight.

Figure 6A:
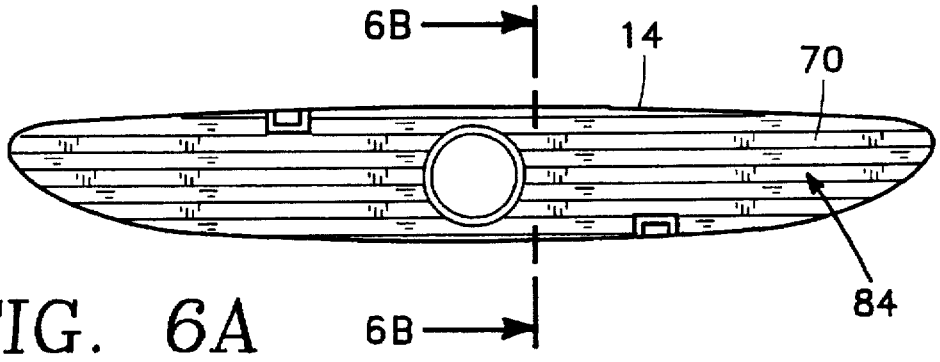
FIG. 6A is a cross-sectional view taken along line 6—6 of an embodiment of FIG. 1 having a meshable interlocking face plate.
Figure 6B:
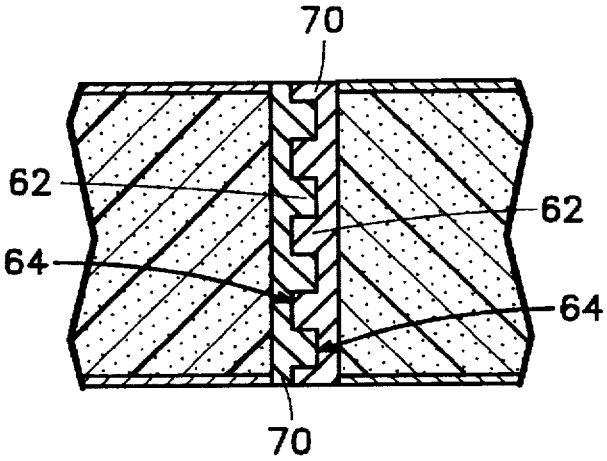
FIG. 6B is a cross-sectional view taken along line 6B—6B of FIG. 6A.

An embodiment having an alternate provision for creating the necessary resistance to any twisting forces encountered is depicted in FIGS. 6A–B. In this embodiment, the face plates 70 have a meshable interlocking pattern 84 on their exterior surface. The raised teeth 62 on a first of the face plates 70 mate with the recesses 64 in the other plate 70, and vice versa. In this way, when the two boards are joined together, the patterns 84 on the respective face plates 70 mesh together and resist any twisting force. In the tested embodiment of the present invention, a 60 shore extruded rubber material was used to fabricate the plates 70.

Figure 7:
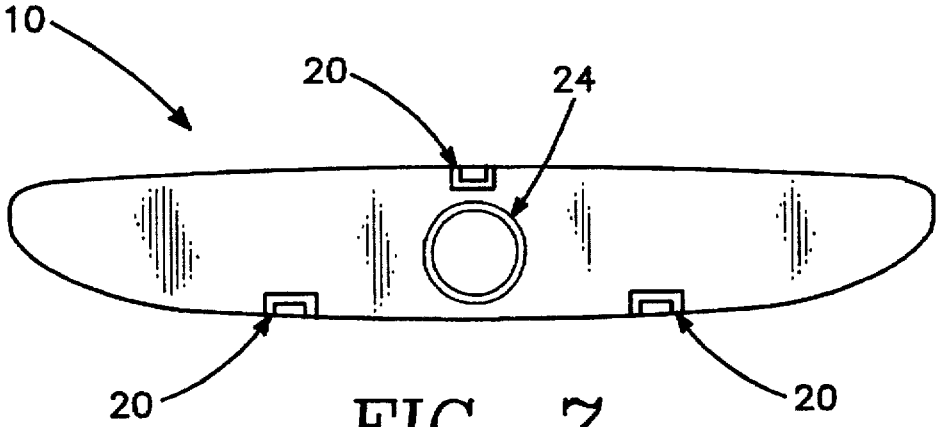
FIG. 7 is a cross-sectional view of an alternate embodiment of FIG. 1 having three clamp assemblies.

The previously described embodiment of the present invention having two clamp assemblies, one on the top and one on the bottom of the board, is preferred where weight is a concern. However, when a heavier surfboard is acceptable, embodiments having more than two clamp assemblies become feasible. FIG. 7 depicts an embodiment of the present invention where two clamp assemblies 20 are disposed on the bottom of the sectionalized surfboard 10, rather than just one. In this embodiment, one clamp assembly 20 is disposed in the top side of the board 10 at its longitudinal midline. Since the upper clamp assembly 20 is placed at the midline, the tube assembly 24 must have cross-sectional dimensions small enough so that there is no interference between the upper clamp assembly 20 and the tube assembly 24. Accordingly, this embodiment could be employed in very thick surfboards where there is adequate clearance between the tube assembly 24 and an upper clamp assembly 20 placed at the midline of the board 10. It could also be employed in a board having a typical width (i.e. on the order of 2.5 inches) where the cross-sectional dimensions of the tube assembly 24 are relatively small, but still sufficient to exhibit the desired stiffness due to the adept selection of material and/or the wall thickness. The two clamp assemblies 20 disposed on the bottom surface of the surfboard 10 are laterally separated form each other at equal distances from the longitudinal midline of the board. Preferably, each assembly 20 is placed at a location approximately halfway between the board's midline and its side rail.

Figure 8:
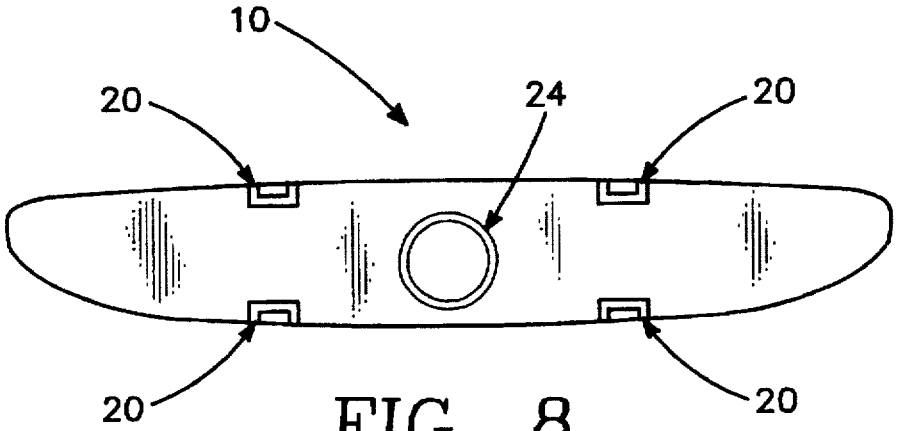
FIG. 8 is a cross-sectional view of an alternate embodiment of FIG. 1 having four clamp assemblies.

FIG. 8 depicts an embodiment of the present invention having a pair of clamp assemblies on each side of the surfboard. This configuration has the advantage of providing a more uniform preload to the sections. In addition, this embodiment could be employed where having an over-center clamp on the top surface (such as the embodiment depicted in FIG. 7) is not possible due an interference condition with the tube assembly 24. However, increasing the total number of clamp assemblies 20 to four increases the weight even more. Therefore, this embodiment should only be employed where the added weight is not a concern. Each clamp assemblies 20 sharing the same side of the surfboard 10 is laterally spaced from the other at an equal distance from the midline of the board (similar to the bottom clamp assemblies of FIG. 7). In addition, each assembly 20 is preferably placed at a location approximately halfway between the board's midline and its side rail.

Referring once again to FIGS. 1A–B and 2, and assuming that the surfboard 10 is in its disassembled condition (as shown in FIG. 2), it is assembled in the following manner. First, one end of the tube 32 is inserted into the sleeve 28, 30 of either surfboard section 12, 14. The other section is then positioned in longitudinal alignment with the first, the free end of the tube 32 is inserted into the other section's sleeve, and the sections are drawn together. While performing this latter step, it is important to ensure that either the pin and socket assemblies 74 (of FIGS. 5A–B) mate, or the face plates 70 with patterned surfaces 84 (of FIGS. 6A–B) mesh, whichever is applicable, such that the two sections 12, 14 are rotationally aligned. Next, the clamp assemblies 20 on the top and bottom of the surfboard 10 are engaged. Finally, the skeg 16 is installed, although this could have been done prior to the joining of the board sections 12, 14, if desired. This completes the assembly and the surfboard 10 is ready for use. To disassemble the board 10, the skeg 16 is removed, the clamp assemblies 20 are disengaged, the two sections 12, 14 are pulled apart, and the tube 32 is removed. The various parts of the surfboard 10 can then be stored and transported as is, or preferably packaged in a carrying case 22 (as shown in FIG. 2)

Figure 9:
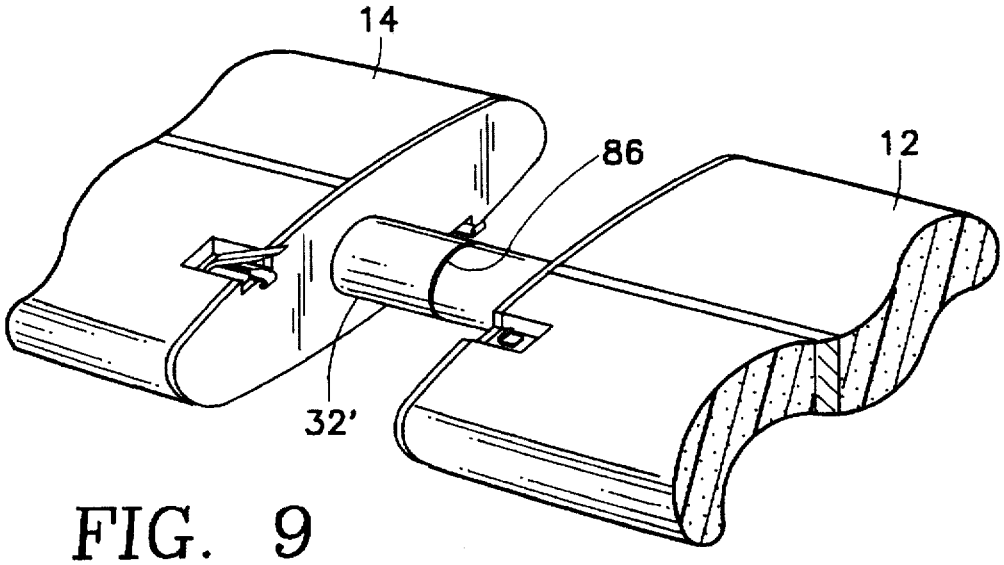
FIG. 9 is a perspective view of an embodiment of the surfboard of FIG. 1 having a grooved tube and shown partially disassembled.

A simple modification to the tube and clamp assemblies will produce an embodiment of the present invention which protects the surfboard from being catastrophically fractured or broken apart during use. Essentially, portions of these assemblies are made to fail when the surfboard is subjected to forces causing a bending moment about the middle of the board (longitudinally) which would otherwise destroy the foam and fiberglass portions of the board. The surfboard is protected because the aforementioned catastrophic damage typically occur when the board is subjected to such excessive bending moments. The modification to the tube assembly entails making the bending strength of the tube less than that of the board sections. This could be done by decreasing its overall diameter and/or wall thickness. However, the preferred method is to form weak point near the midlength of the assembly's tube member. For example, as shown in FIG. 9, the wall of the tube 32' has a groove 86 around its circumference so as to reduce its thickness in that region. Preferably, the tube 32' is weaken to a degree that it will collapse in the presence of a bending moment which is slightly less than that required to fracture the foam and fiberglass sections 12, 14 of the surfboard. The exact degree of weakening will of course vary from one model of surfboard to another. However, it is believed this value can be easily determined by those skilled in the art using well known testing methods. Referring to FIG. 4, the modification to the clamp assembly 20 preferably entails choosing an adjustable lock piece 56 with a narrow enough diameter that it will fail under a tensile force corresponding to a tensile force which would be exerted on the clamp assembly 20 in response to the aforementioned bending moment (which is slightly less than that necessary to cause the board to fracture). Here again, those skill in the art are capable of easily determining this lesser tensile force and selecting an adjustable lock piece diameter which will fail first under this force.

Figure 10:
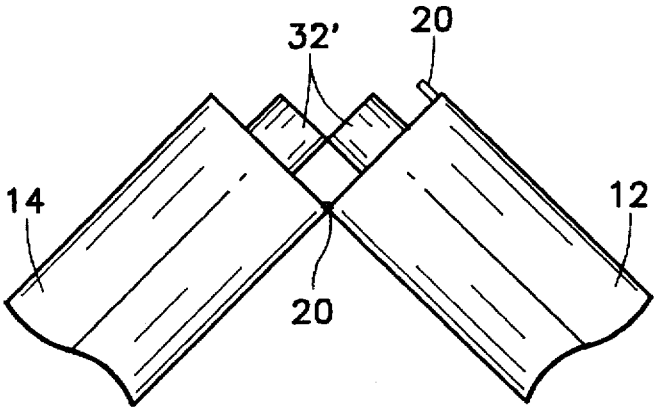
FIG. 10 is a side view of an embodiment of the surfboard of FIG. 1 which incorporates a breakable clamp assembly link and grooved tube, shown in the failed mode.

In operation, the modification to the clamp and tube assemblies causes the clamp 40 on the side of the surfboard which comes under tension from a sufficiently large bending moment to break open. The sections 12, 14 of the board will then rotate around the remaining clamp assembly 20 (at least initially) and the tube 32' will break and/or crimp, as shown in FIG. 10. At some point, the remaining clamp assembly 20 may become disengaged due to the aforementioned pivoting. The net result is that the forces which could have destroyed the surfboard are instead dissipated by sacrificing the adjustable lock piece 56 of the clamp and the tube 32'. These relatively small and inexpensive items can be easily replaced with spare parts right at the beach. Within a matter of moments the surfboard can be back in working condition and ready to used again, rather than being a total loss.

Figure 11:
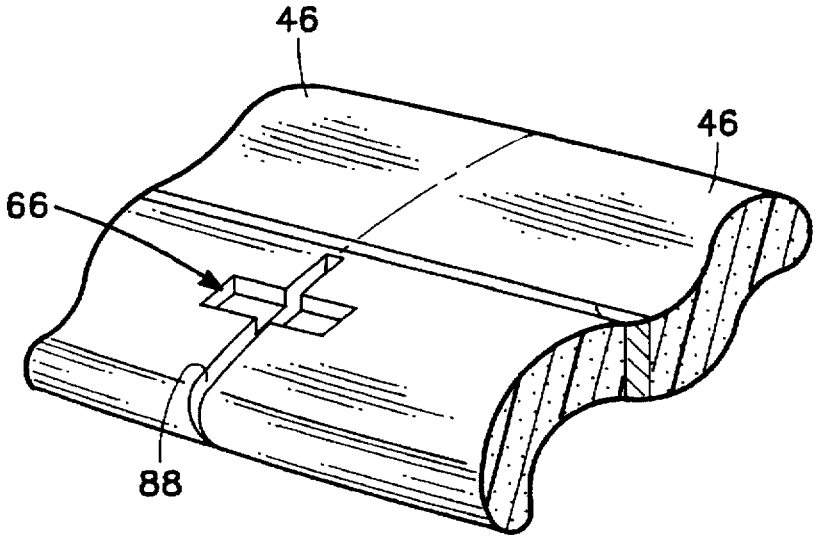
FIGS. 11 and 12 illustrate successive stages of a method of manufacture of the surfboard of FIG. 1.
Figure 12:
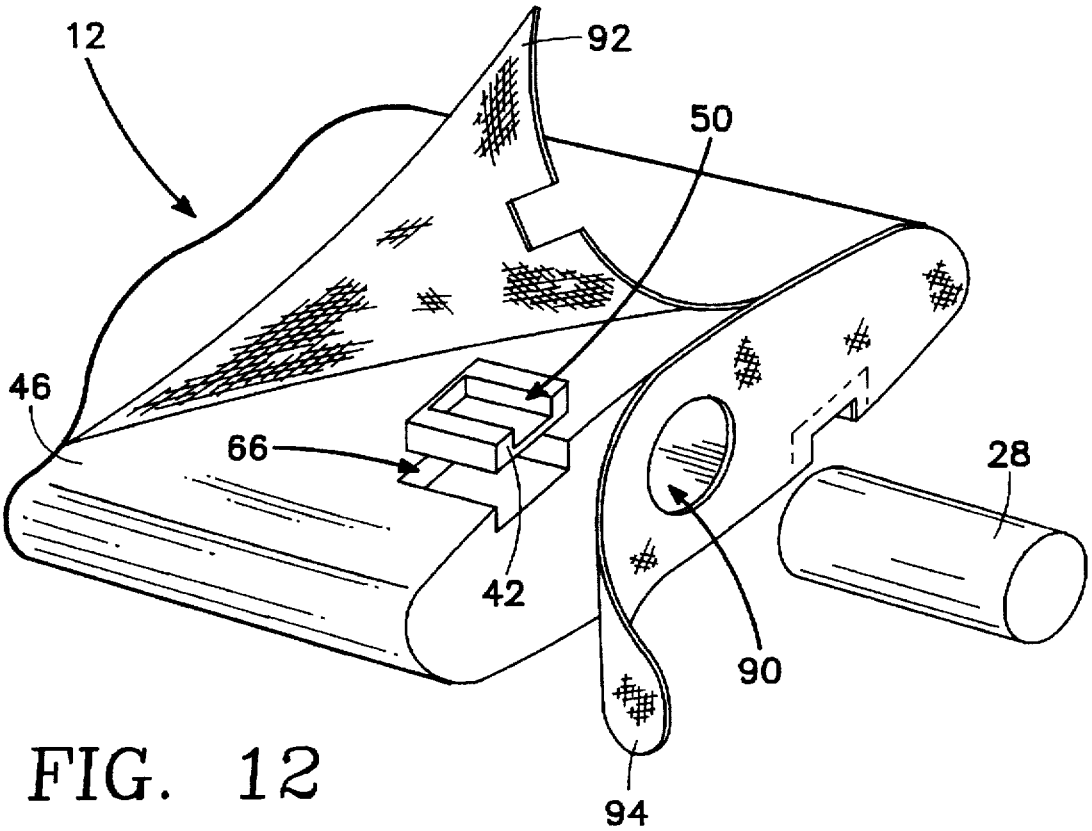

FIGS. 11 and 12 illustrate an exemplary method of constructing the individual board sections described herein above. A rectangular recess 66 for the clamp assembly is formed at the appropriate location on both sides of the core 46, as shown for the top side in FIG. 11. One way of forming these recesses 66 is to initially form the core 46 of the surfboard in a customary manner, then rout each recess 66 into the core 46. The core 46 is then cut laterally through approximately the middle of the recesses 66, as shown at 88, to create the core portion of the two sections of the surfboard. At this point, a hole 90 is bored in each core section to receive the tube assembly.

The finishing stages of the represented section are accomplished in the manner shown in FIG. 12. Initially, the divided recesses 66, and hole 90 are coated with a suitable resin, such as an isothalic polyester resin. The brackets 42 associated with the clamp assemblies, and sleeve 28 associated with the tube assembly, are then positioned in place. The depth of the divided recesses 66 match the dimensions of the bracket 42 whereby the exterior surface of the bracket is essentially flush with the surface of the core 46. Likewise, the depth and dimensions of the hole 90 matches the dimensions of the sleeve 28, and place the open end of the sleeve flush with the surface of the core section. Each core section is now laminated with a sheet fiber glass 92, including the portions of the brackets 42 surrounding the clamp pockets 50. Covering the aforementioned portions of the brackets transfers tensile loads between the brackets and the fiberglass skin of the board, thereby strengthening the connection between the brackets 42 and their respective board sections 12, 14. This added strength is needed to prevent a separation of the brackets 42 from the board sections 12, 14, as might occur if the adhesive joint between the bracket 42 and the foam core of each section were to be relied upon alone the transfer tensile loads. Fiber glass 94, or some other rigid material is also laminated over the ends of the core sections to form the backing plate.

The flexible face plate is then affixed to the backing plate (see FIG. 6). If the embodiment employing pin and socket assemblies is to be produced, the respective apertures and bores are drilled. The pins and sockets (if used) are then installed (see FIGS. 5A–B). Alternately, if the embodiment employing a face plate with the patterned surface is to be produced, these last steps associated with the pin and socket assemblies are omitted. Finally, the clamps are installed (see FIG. 4). The finished board sections are now ready to be assembled or stored/transported, as described previously.

It is noted that rather than routing the recesses into the core and cutting the core into parts, the core sections could be molded separately instead. In this method, the recesses would be integrally formed in each core section. As molding methods and apparatuses capable of producing such core sections are well known in the art, no further description is provided herein.

A significant advantage of the present invention is that an existing surfboard can retrofitted with the components necessary to make it sectional and damage resistant. In this way, a surfer's favorite board can be transformed into a sectionalized board according to the present invention and enjoy all the benefits thereof. Specifically, the above-described method for producing a sectionalized surfboard can be adapted to modify an existing board. The recesses would simply be routed into the core of the board through the fiber glass shell before cutting the it in half through the middle of the recesses. Other than this change, the procedure is essentially the same except that step of laminating the fiber glass to the external surface of the core sections is not require as it the shell is already in place. However, to ensure a strong connection between the brackets and their respective board sections, it is preferred that a small sheet of fiberglass cloth be laminated over the portions of the brackets surrounding the clamp pockets, as well as a portion of the fiberglass shell of the board adjacent to the brackets. This will tie the fiberglass shell to the brackets, thereby allowing tensile loads to be transfer therebetween.

While the invention has been described in detail by reference to the preferred embodiment described above, it is understood that variations and modifications thereof may be made without departing from the true spirit and scope of the invention. For example, although the preferred embodiments of the present invention divide the surfboard into two sections, this need not be the case. The board could be divided three or more sections. Each joint between the sections would incorporated the same elements as described hereinabove in connection with the single joint of the two-part sectionalized surfboard. It is noted that board having three or more sections could be packaged more conveniently as each section would be shorter. Thus, a shorter (although thicker) carrying case could be used. However, it is also pointed out that each joint adds weight to the surfboard. Where weight is a concern a two section board is preferred.

Wherefore, what is claimed is:

1. A sectionalized, disassemblable board-like hull comprising:

a front section having a first interfacing surface;

a rear section having a second interfacing surface matable to the first interfacing surface; and a connecting apparatus capable of releasably connecting the front section to the rear section in longitudinal alignment such that the first interfacing surface abuts the second interfacing surface to form a joint therebetween, said connecting apparatus comprising, a single loadbearing tube extending concentrically along a centrally located longitudinal axis of the hull at said joint, wherein a first portion of the tube assembly extends into a hole formed in the front section through the first interfacing surface and a second portion of the tube assembly extends into a hole in the rear section through the second interfacing surface, said single loadbearing tube bearing most of the bending and shear forces exerted on the hull at said joint.

2. The hull of claim 1, wherein the connecting apparatus further comprises a first clamp assembly located in an upper surface of the hull and a second clamp assembly located in a bottom surface of the hull, both of which bridge the joint between the front section and the rear section and which when engaged hold the front and rear sections together longitudinally.

3. The hull of claim 2 wherein the first clamp and second clamp are disposed as close to a longitudinal midline of the hull as possible without interfering with the tube.

4. The hull of claim 3, wherein a diameter of the tube is such that the first clamp and second clamp cannot be disposed at the longitudinal midline of the hull, and wherein the first clamp is disposed laterally to one side of the midline and the second clamp is disposed laterally to the side of the midline opposite from that of the first clamp.

5. The hull of claim 1, wherein the connecting apparatus further comprises:

a first sleeve disposed in the hole formed in the front section and having an open end opening out from the first interfacing surface and a closed end facing the interior of the front section;

a second sleeve disposed in the hole formed in the rear section and having an open end opening out from the second interfacing surface and a closed end facing the interior of the rear section; and wherein the single loadbearing tube comprises a tube, closed at both ends, which when installed is disposed partially in the first sleeve and partially in the second sleeve.

6. The hull of claim 5, wherein the tube has a length less than a combined length of the first and second sleeves such that when installed in the first and second sleeves a clearance space exists between an end of the tube and the closed end of at least one of the first and second sleeves.

7. The hull of claim 5, wherein the first and second sleeves and tube have a circular cross-section and the tube has an outside diameter sufficient to create a close sliding fit between it and the first and second sleeves when installed therein.

8. The hull of claim 5, wherein the front and rear sections comprise a stringer disposed edgewise along the midline of the hull and extending from a top surface of the hull to a bottom surface thereof, and wherein the first and second sleeves are partially embedded into the stringer.

9. The hull of claim 1 wherein the cross-sectional height of the tube is within a range of about 25 percent to about 90 percent of the cross-sectional height of the hull at the joint.

10. The hull of claim 5, wherein the tube exhibits a bending and shear strength which approximately equals or exceeds a bending and shear strength exhibited by the front and rear sections.

11. The hull of claim 1, wherein the connecting apparatus further comprises:

a first clamp assembly located in an upper surface of the hull and a second clamp assembly located in a bottom surface of the hull, both of which bridge the joint between the front section and the rear section and which when engaged hold the front and rear sections together longitudinally;

a first sleeve disposed in the bore formed in the front section and having an open end opening out from the first interfacing surface and a closed end facing the interior of the front section;

a second sleeve disposed in the bore formed in the rear section and having an open end opening out from the second interfacing surface and a closed end facing the interior of the rear section; and wherein the single loadbearing tube comprises a tube closed at both ends which when installed is disposed partially in the first sleeve and partially in the second sleeve.

12. The hull of claim 11 wherein:

the first and second clamp assemblies each comprise a breakable link having a tensile strength such that whenever the hull is subjected to a prescribed bending moment the link breaks first causing the corresponding clamp assembly to disengage; and the tube exhibits a bending strength such that whenever the hull is subjected to the prescribed bending moment the tube breaks or crimps; and wherein the prescribed bending moment is less than a bending moment sufficient to fracture the hull sections.

13. The hull of claim 12, wherein the bending strength exhibited by the tube is determined the depth of a circumferential groove located at about the midlength of the tube.

14. The hull of claim 1, further comprising an anti-rotation device capable of maintaining the front section in rotational alignment with the rear section about the longitudinal axis.

15. The hull of claim 14, wherein the anti-rotation device comprises at least one pin and socket assembly, each pin and socket assembly comprising:

a pin projecting outward from the interfacing surface of one section; and a mating socket disposed in the interfacing surface of the other section at a location that causes the pin to slide into the socket whenever the first interfacing surface is abutted to the second interfacing surface in rotational alignment.

16. The hull of claim 14 wherein the anti-rotation device comprises a meshable pattern formed on the first and second interfacing surfaces, said pattern on the first interfacing surface meshing with the pattern on the second interfacing surface whenever the first and second interfacing surfaces are abutted to one another in rotational alignment.

17. The hull of claim 2 wherein the first interfacing surface and the second interfacing surface each comprise:

a backing plate comprising a rigid material, said backing plate being attached to the associated front or rear sections; and a flexible face plate comprising an elastically compressible material, said face plate being attached to the backing plate.

18. The hull of claim 17 wherein first and second clamp assemblies are capable of being adjusted so as to vary the compressive force placed on each face plate.

19. The hull of claim 18 wherein the first and second clamp assemblies are adjusted so as to create a compressive preload force on the face plates of approximately 100 pounds.

20. The hull of claim 1 wherein the connecting apparatus comprises elements made of light-weight materials.

21. The hull of claim 1, wherein the connecting apparatus comprises elements made of at least one of (i) aluminum, (ii) plastic, and (iii) resin-fiber composite material.

22. The hull of claim 2, further comprising clamp assembly covers which cover the engaged clamp assemblies, said covers being flush with the exterior surface of the hull.

23. A method for sectionalizing a board-like hull comprising the steps of:

forming a front section having a first interfacing surface;

forming a rear section having a second interfacing surface matable to the first interfacing surface; and releasably connecting the front section to the rear section in longitudinal alignment such that the first interfacing surface abuts the second interfacing surface to form a joint therebetween by employing a single loadbearing tube extending concentrically along a centrally located longitudinal axis of the hull at said joint.

24. The method of claim 23, wherein the connecting step further comprises employing a first clamp assembly located in an upper surface of the hull and a second clamp assembly located in a bottom surface of the hull, both of which bridge the joint between the front section and the rear section and which when engaged hold the front and rear sections together longitudinally.

25. The method of claim 24, wherein the tube exhibits a bending and shear strength which approximately equals or exceeds a bending and shear strength exhibited by the front and rear sections.

26. The method of claim 24, wherein:

the first and second clamp assemblies each comprise a breakable link having a tensile strength such that whenever the hull is subjected to a prescribed bending moment the link breaks and causes the corresponding clamp assembly to disengage; and the tube exhibits a bending strength such that whenever the hull is subjected to the prescribed bending moment the tube breaks or crimps; and wherein the prescribed bending moment is less than a bending moment sufficient to fracture the hull sections, thereby sacrificing the breakable link and the tube and protecting the hull sections whenever the hull is subjected to a bending moment capable of fracturing the hull sections.

27. The method of claim 23, wherein the connecting step further comprises maintaining the front section in rotational alignment with the rear section about the longitudinal axis.

28. The method of claim 23, wherin the cross-sectional height of the tube is within a range of about 25 percent to about 90 percent of the cross-sectional height of the hull at a location of the joint coinciding with the centrally located longitudinal axis of the hull.

29. A sectionalized, disassemblable board-like hull comprising:

a plurality of hull sections each having at least one interfacing surface; and a joining system for detachably securing the hull sections to one another in longitudinal alignment wherein adjacent interfacing surfaces abut and form a joint therebetween, said joining system comprising, a single loadbearing tube disposed within each adjoining hull section and bridging the joint associated therewith, each tube extending concentrically along a centrally located longitudinal axis of the hull at the associated joint, and at least one clamp assembly located in an upper surface of the hull and at least one clamp assembly located in a bottom surface of the hull at each joint between adjoining hull sections, said clamp assemblies bridging the associated joint, and whenever engaged, holding the adjoining sections together longitudinally.

30. The hull of claim 29, wherein:

a single clamp assembly is located in the upper surface of the hull at a longitudinal midline thereof; and two clamp assemblies are located in the bottom surface of the hull, said clamp assemblies in the bottom surface being laterally separated from one another and disposed on either side of the longitudinal midline of the hull.

31. The hull of claim 29, wherein:

two clamp assemblies are located in the upper surface of the hull, said clamp assemblies in the upper surface being laterally separated from one another and disposed on either side of the longitudinal midline of the hull; and two clamp assemblies are located in the bottom surface of the hull, said clamp assemblies in the bottom surface also being laterally separated from one another and disposed on either side of the longitudinal midline of the hull.

* * * * *